US007003901B2

(12) United States Patent
Petzl et al.

(10) Patent No.: US 7,003,901 B2
(45) **Date of Patent: *Feb. 28, 2006**

(54) ICE CRAMPON FOR MOUNTAIN CLIMBING FITTED WITH A FASTENING DEVICE WITH A LATERAL OPERATING LEVER

(75) Inventors: Paul Petzl, Barraux (FR); Alain Maurice, Meylan (FR)

(73) Assignee: Zedel, Crolles (FR)

( * ) Notice: Subject to any disclaimer, the term of this patent is extended or adjusted under 35 U.S.C. 154(b) by 0 days.

This patent is subject to a terminal disclaimer.

(21) Appl. No.: 10/211,536

(22) Filed: Aug. 5, 2002

(65) Prior Publication Data

US 2003/0037461 A1 Feb. 27, 2003

(30) Foreign Application Priority Data

Aug. 27, 2001 (FR) ..... 01 11140

(51) Int. Cl.
*A43B 15/00* (2006.01)
*A43B 3/10* (2006.01)

(52) U.S. Cl. ..... 36/7.6; 36/7.7; 36/62; 36/64

(58) Field of Classification Search ..... 36/7.5, 36/7.6, 7.7, 59 R, 62, 64, 66
See application file for complete search history.

(56) References Cited

U.S. PATENT DOCUMENTS

| | | | | | |
|---|---|---|---|---|---|
| 784,119 | A | * | 3/1905 | Norlund et al. | 36/64 |
| 1,059,853 | A | * | 4/1913 | Feister | 36/64 |
| 1,241,821 | A | * | 10/1917 | Cerruti | 36/64 |
| 1,329,064 | A | * | 1/1920 | Ullrich | 36/7.7 |
| 1,374,418 | A | * | 4/1921 | Becker | 36/64 |
| 1,967,867 | A | * | 7/1934 | Conway | 36/7.7 |
| 2,160,601 | A | * | 5/1939 | Moriarty | 36/7.7 |
| 2,595,694 | A | * | 5/1952 | Ogden | 36/7.6 |
| 2,693,040 | A | * | 11/1954 | Von Essen | 36/62 |
| 3,685,173 | A | * | 8/1972 | Piazza | 36/7.6 |
| 4,910,883 | A | * | 3/1990 | Zock, Jr. | 36/7.6 |
| 6,481,121 | B1 | * | 11/2002 | Tucker | 36/62 |

FOREIGN PATENT DOCUMENTS

| | | |
|---|---|---|
| FR | 914 269 A | 10/1946 |
| FR | 918 743 A | 2/1947 |
| FR | 2 106 932 A | 5/1972 |
| WO | WO 98/36654 | 8/1998 |

* cited by examiner

*Primary Examiner*—M. D. Patterson
(74) *Attorney, Agent, or Firm*—Oliff & Berridge, PLC

(57) ABSTRACT

An ice crampon for mountain climbing comprising a reinforcement 12B with a metal reinforcement, fitted with anchoring teeth 14, and a fastening device 30 comprising a lateral operating lever 32 forming a toggle joint for locking or unlocking the heel of the shoe along the pivoting direction of the operating lever 32.

9 Claims, 8 Drawing Sheets

ICE CRAMPON FOR MOUNTAIN CLIMBING FITTED WITH A FASTENING DEVICE WITH A LATERAL OPERATING LEVER

TECHNICAL FIELD OF THE INVENTION

The invention relates to an ice crampon for mountain climbing comprising a metal reinforcement with anchoring teeth, and a fastening device for interconnection of the reinforcement to the sole of a shoe via a first fastening element and a second fastening element, arranged respectively at the front and at the rear of the reinforcement.

STATE OF THE ART

The fastening devices known for ice crampons use generally a first stirrup at the front, and a locking cam system, provided along a pivoting heel piece protruding at the rear of the shoe. The heel piece is carried by a second stirrup having lateral arms adjustable in length. Such a device is rather heavy and cumbersome.

OBJECT OF THE INVENTION

The object of the invention consists in realizing an ice crampon fitted with a light fastening device, adjustable without disassembly, and easy to operate for locking and for unlocking.

The ice crampon according to the invention is characterized in that the fastening device comprises a lateral operating lever and a means for accommodating the end of the first or second fastening element, in order to realize a toggle joint for locking or unlocking the ice crampon on the sole along the pivoting direction of said lever.

The means for accommodating the first or the second fastening element is formed by a rotary socket carried by an extension of the operating lever. Said lever is elbow-shaped and composed of a gripping arm offset angularly with respect to the extension.

According to a preferred embodiment, the means of accommodation is formed by an intermediate rod mounted to pivot around an axle, and acting as an articulation member for the operating lever.

The reinforcement is composed of a front frame linked to a rear frame by a linking bar adjustable in length in relation to the size of the shoe. The axis of articulation of the operating lever can be housed in a first rack enabling longitudinal adjustment of the first or second fastening element. The other end of the fastening element is mounted directly in a second rack situated on the side opposite to the operating lever. Both racks are arranged symmetrically with respect to the median longitudinal plane of the reinforcement.

According to another characteristic of the invention, the second fastening element is composed of a stirrup comprising two buckles for hooking a safety belt. The gripping end of the operating lever is arranged to engage into one of the buckles in locking position. A ring for unlocking the lever is made active to cross over the neutral point of the toggle joint in order to unlock it.

BRIEF DESCRIPTION OF THE DRAWINGS

Other advantages and characteristics will appear more clearly using the following description of an embodiment of the invention given for exemplification purposes, without limitation thereto, and represented on the appended drawings, wherein.

DESCRIPTION OF A PREFERRED EMBODIMENT

Figure 1:
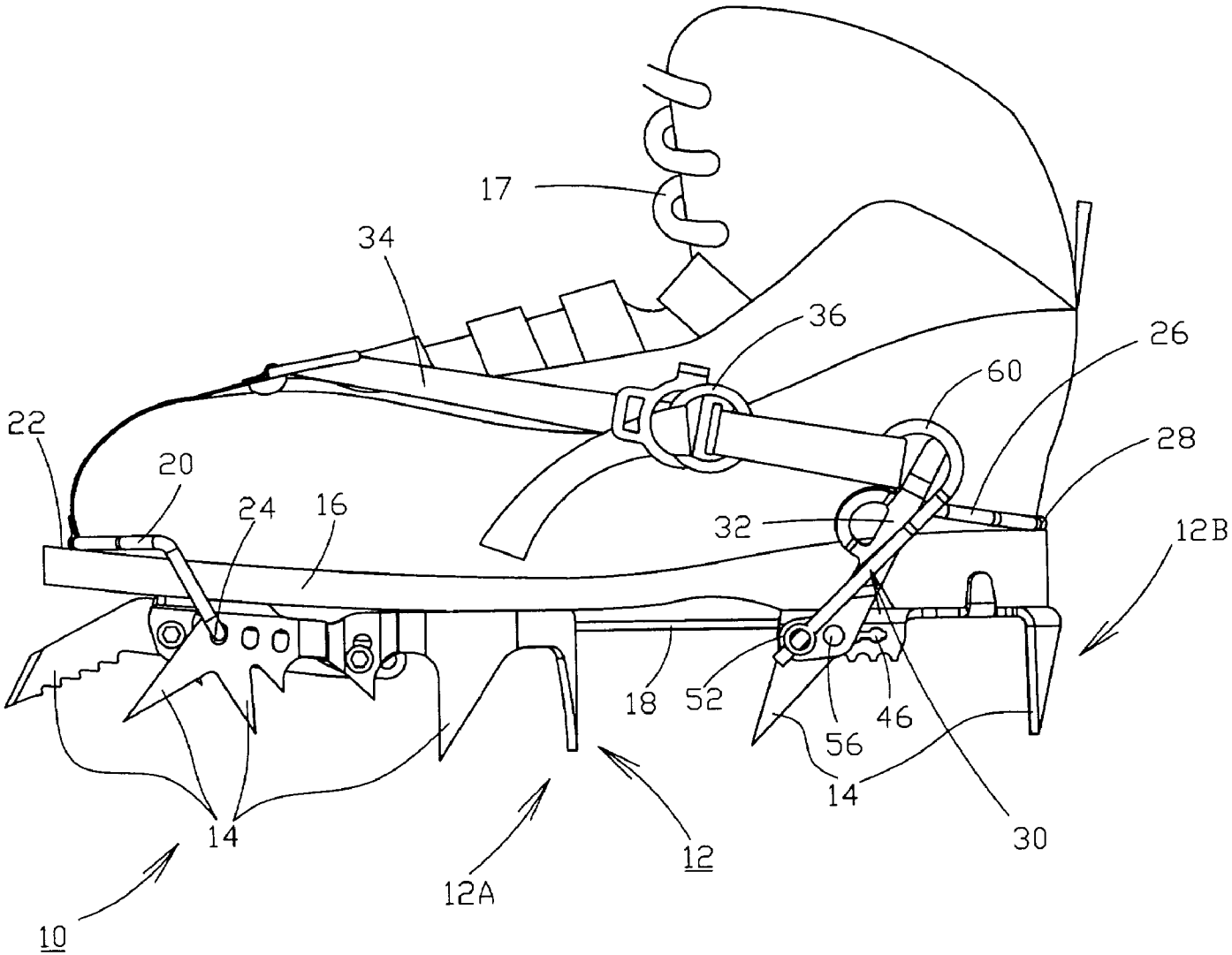
FIG. 1 is an elevation view of the ice crampon mounted under the sole of a shoe.

With reference to FIG. 1, an ice crampon 10 for mountain climbing comprises a metal reinforcement 12 fitted with a plurality of vertical anchoring teeth intended for penetrating into ice or hard snow, to enable safe progression over an iced terrain. The reinforcement 12 is mounted under the sole 16 of a mountain shoe 17 and is composed of a front frame 12A linked to a rear frame 12B by a linking bar 18, which bar is adjustable in length in relation to the size of the shoe.

The front frame 12A of the reinforcement 12 is fitted with a first fastening element 30 in the form of a stirrup resting on the front rim 22 of the sole 16. The stirrup 20 is U-shaped thanks to a steel wire, whereof the opposite ends are mounted to toggle around a transversal axle 24. The stirrup 20 can also be replaced with a stop fitted with belts covering the front of the shoe.

The rear frame 12B of the reinforcement 12 is fitted with a second fastening element 26 engaging into the rear rim 28 of the heel of the sole 16. The second fastening element 26 comprises for exemplification purposes a metallic stirrup.

A fastening device 30 with a lateral operating lever 32 is associated with the second fastening stirrup 26 for locking and unlocking the heel of the shoe 17 on the ice crampon 10, further to longitudinal displacement of the second fastening stirrup 26 with respect to the first stirrup 20 of the front frame 12A. A safety belt 34 is integral with the second fastening stirrup 26, in order to surround the stem of the shoe 17 by means of a retaining system 36.

With reference to FIGS. 2 to 5, the rear frame 12B of the reinforcement 12 comprises a bearing surface 38 of the sole 16, said surface is punched in the central portion by an opening 40. A folded extension 42 of the transversal branch 43 of the rear frame 12B is fitted with a rectangular orifice 44 to let through the linking bar 18.

On either side of the body of the rear frame 12B is laid out a rack 46 with several notches distributed along the longitudinal direction for adjustment of the fastening device 30.

One of the ends 48 of the second fastening stirrup 26 is mounted directly in the rack 46 on the side opposite to the operating lever 32. The other end 50 of the fastening stirrup 26 goes through a socket 52 mounted to rotate freely on an elbow-shaped extension 54 of the operating lever 32. The axis of articulation 56 of the operating lever 32 is inserted in the corresponding rack 46, and is offset with respect to the rotary socket 52 carried by the extension 54. Each end 48, 50 of the fastening stirrup 26 comprises a flat surface 58

(visible on the end 48 of FIG. 5) whereof the width is greater than the diameter of the adjustment holes provided in the racks 46.

The fastening stirrup 26 comprises moreover two buckles 60 using for hooking the safety belt 34.

The elbow-shaped operating lever 32 forms a toggle joint with the lateral side of the second fastening stirrup 26.

When the fastening device 30 is unlocked (FIGS. 3 and 4), the toggle joint is in broken position, and the operating lever 32 is tipped forward while remaining hinged at the rack 46 by the axle 56, which axle is located above the lateral side of the fastening stirrup 26.

Figure 4:
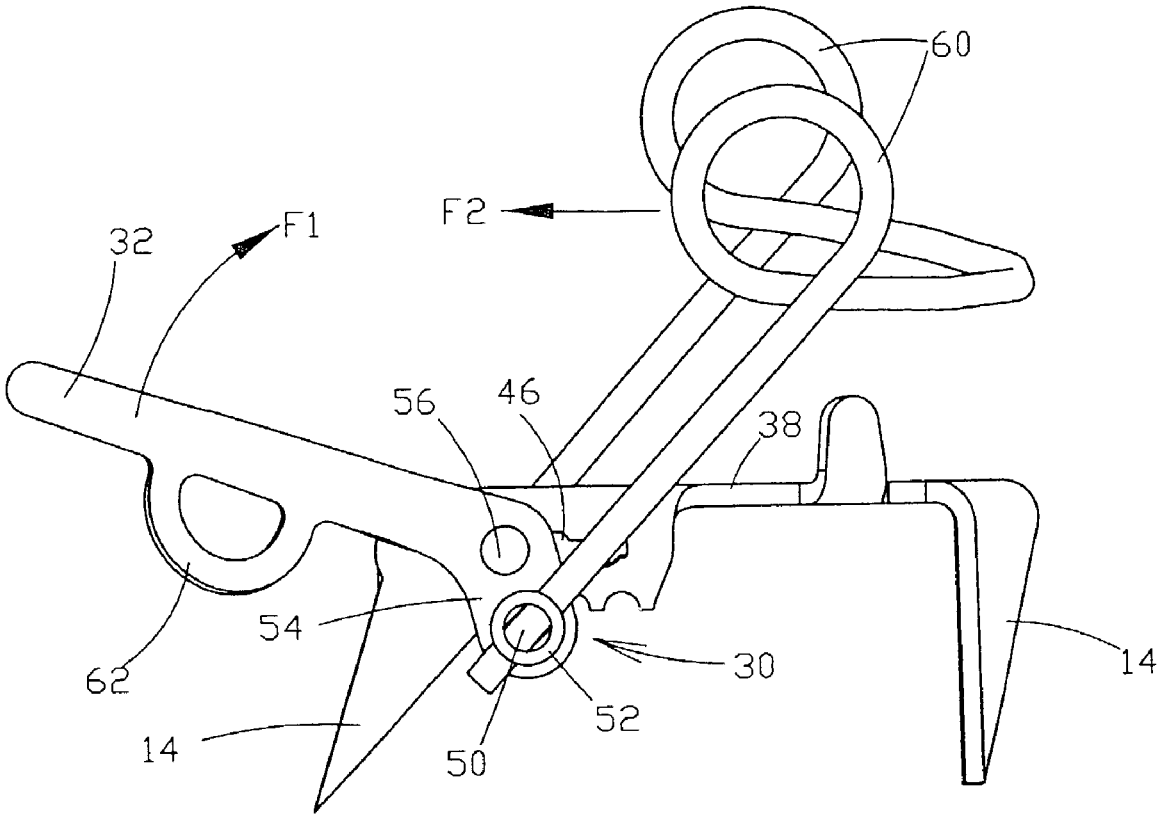
FIG. 4 shows an elevation view of FIG. 3.
Figure 5:
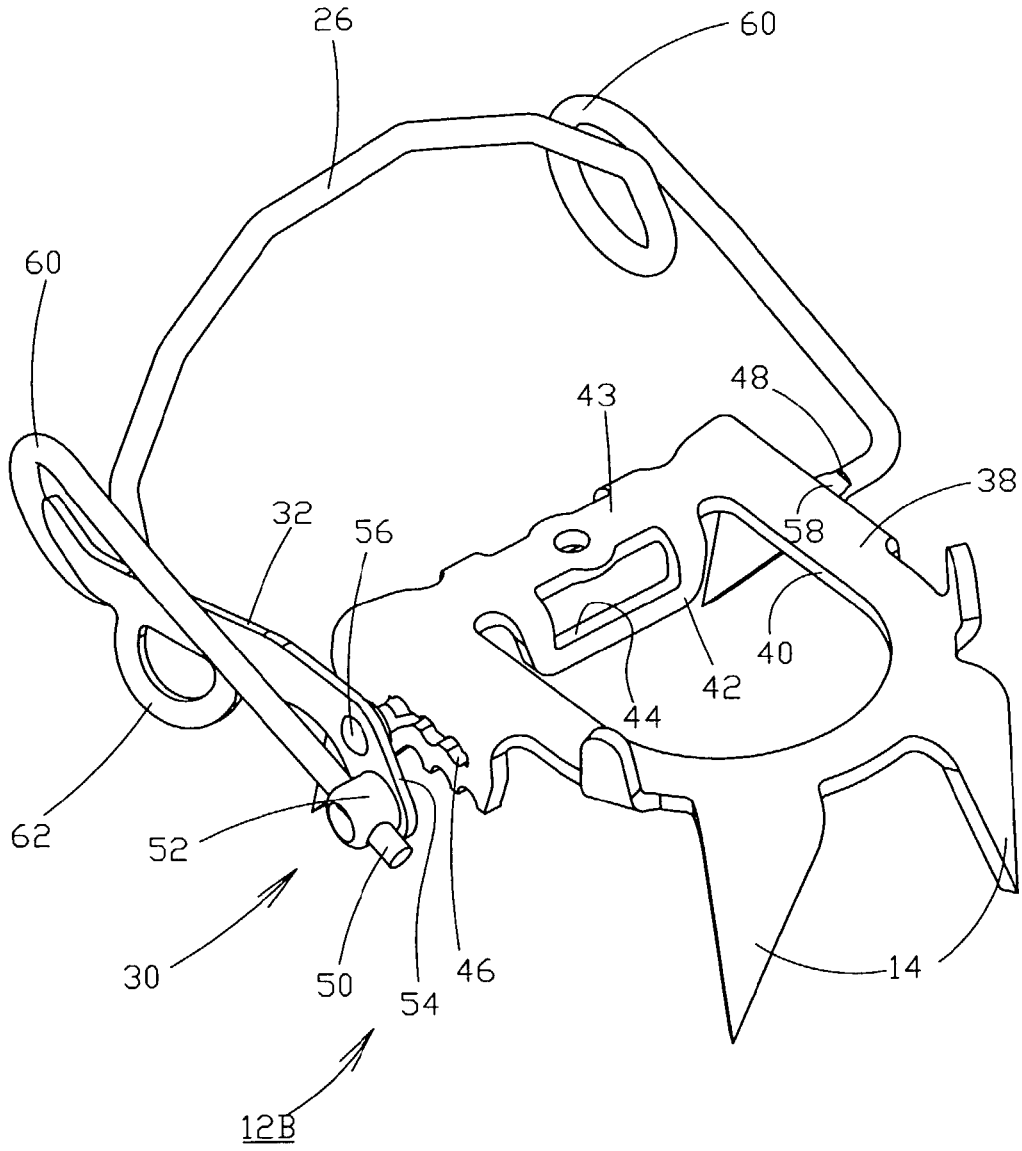
FIG. 5 represents an exploded perspective view of the rear frame and of the fastening device.

Changing to the locked condition of the fastening device 30 (FIGS. 1 and 2) is made by pivoting the lateral operating lever 32 clockwise as indicated on FIG. 4 by the arrow F1. The socket 52 is driven into the same direction while describing an arc of circle centred on the axle 56. The second fastening stirrup 26 is pulled in forward translation (arrow F2), in order to tighten the rear rim 28 of the heel of the sole 16 as much as possible. During this displacement, the toggle joint crosses over the neutral position when the axle 56 passes below the lateral side of the fastening stirrup 26.

The presence of the toggle joint makes this locking position of the operating lever 32 perfectly stable. The gripping end of the operating lever 32 engages moreover into one of the buckles 60 of the stirrup 26 in order to prevent any accidental unlocking.

Figure 2:
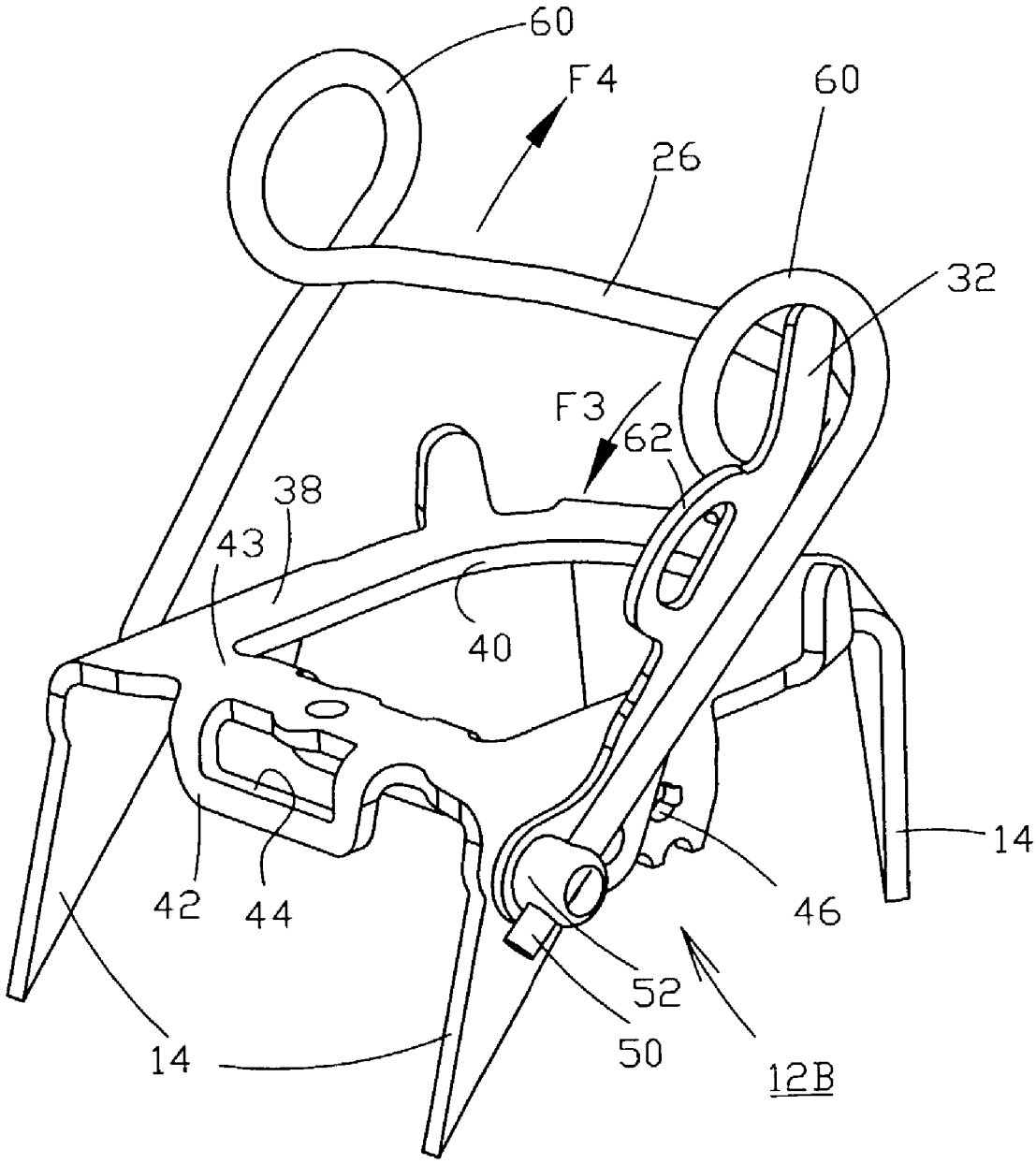
FIGS. 2 and 3 are perspective views of the rear frame of the ice crampon, whereas the operating lever of the fastening device is respectively in a locking position and in an unlocking position.
Figure 3:
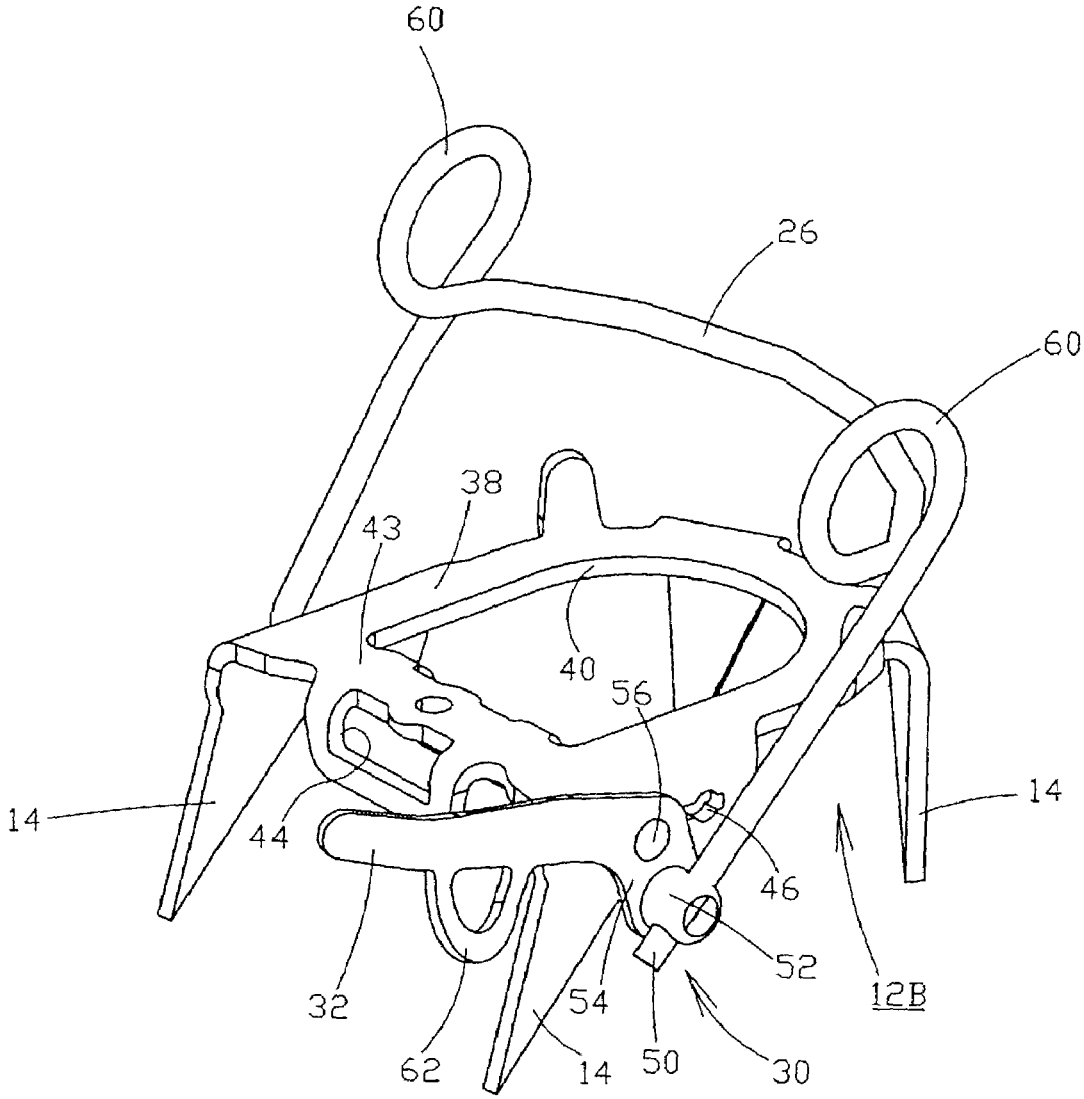

Changing to the unlocked condition of the fastening device 30 is made by pulling the ring 62 of the operating lever 32 in the direction of the arrow F3 (FIG. 2). The process is reverted with respect to that of the locking, and the operating lever 32 comes back into the position of FIG. 3 while bringing about the rearward translation of the second fastening stirrup 26 (arrow F4). The clearance is then sufficient to release the heel 28 of the shoe.

Figure 6:
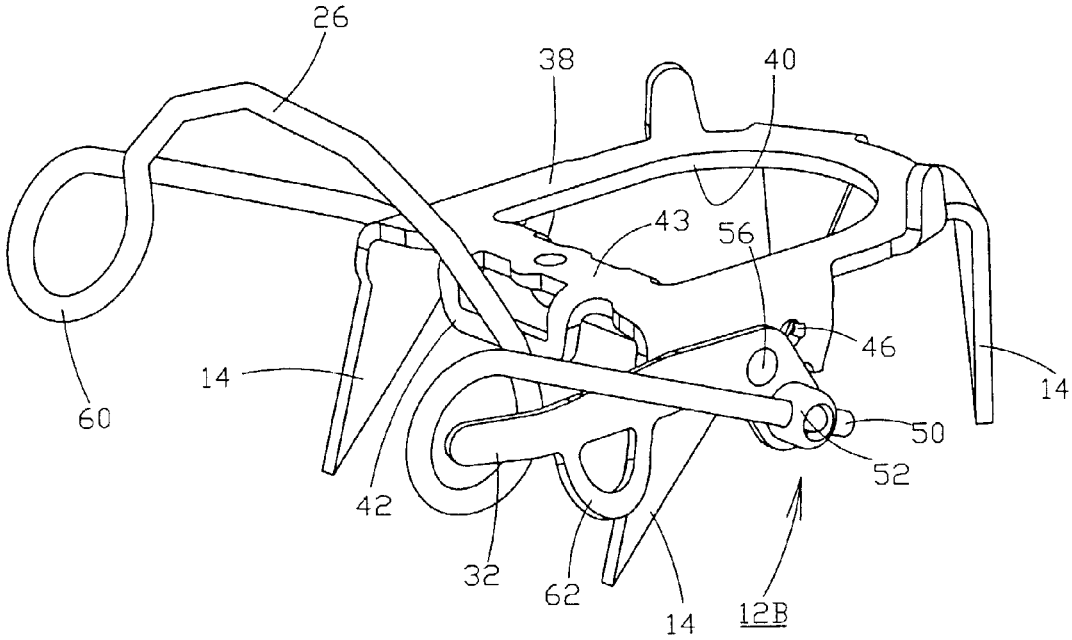
FIGS. 6 and 7 are identical views of FIGS. 3 and 4 during the phase of length adjustment in the racks.
Figure 7:
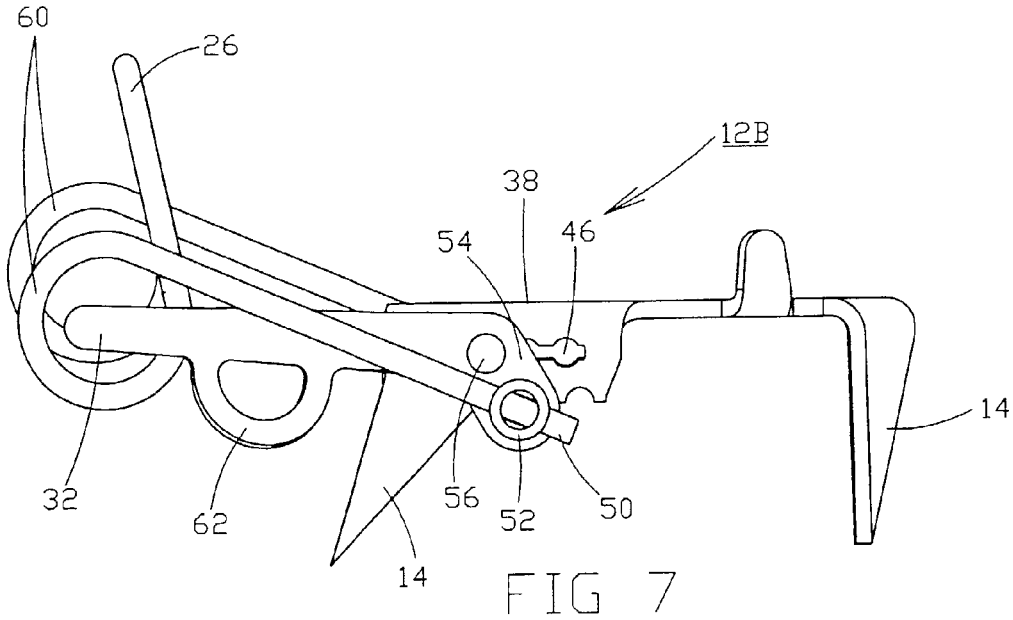

With reference to FIGS. 6 and 7, the symmetrical arrangement of both racks 46 in the body of the rear frame 12B, enables the translation of the assembly composed of the fastening stirrup 26 and of the fastening device 30 between several positions. This adjustment requires no disassembly, while tipping the lever 32 and the stirrup 26 forward completely. Matching the flat surface 58 with the longitudinal slot of the racks 46 enables translation up to a preset adjustment position. This longitudinal position remains stable after recalling the stirrup 26 backward.

Both symmetrical racks 46 can be replaced with any other adjustment means in order to adjust the longitudinal positioning of the second fastening stirrup 26 with respect to the rear frame 12B.

It is obvious that the toggle joint fastening device 30 described previously can be used without any rack adjustment system of the fastening device 30. There remains therefore the adjustment in length of the linking bar 18 in relation to the shoe size.

Figure 8:
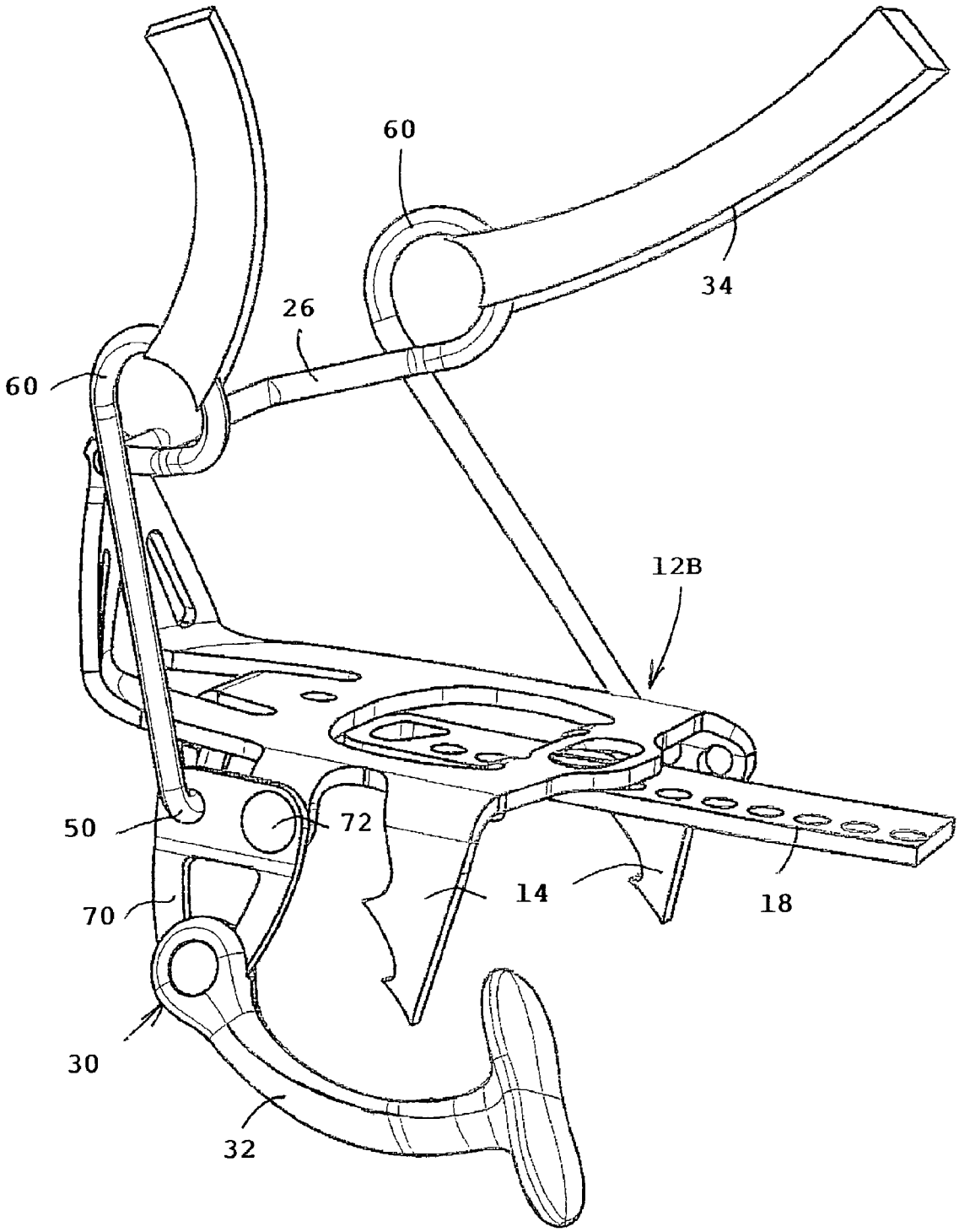
FIGS. 8 and 9 show an embodiment of the rear frame, respectively in the unlocking position and in the locking position of the lateral operating lever.
Figure 9:
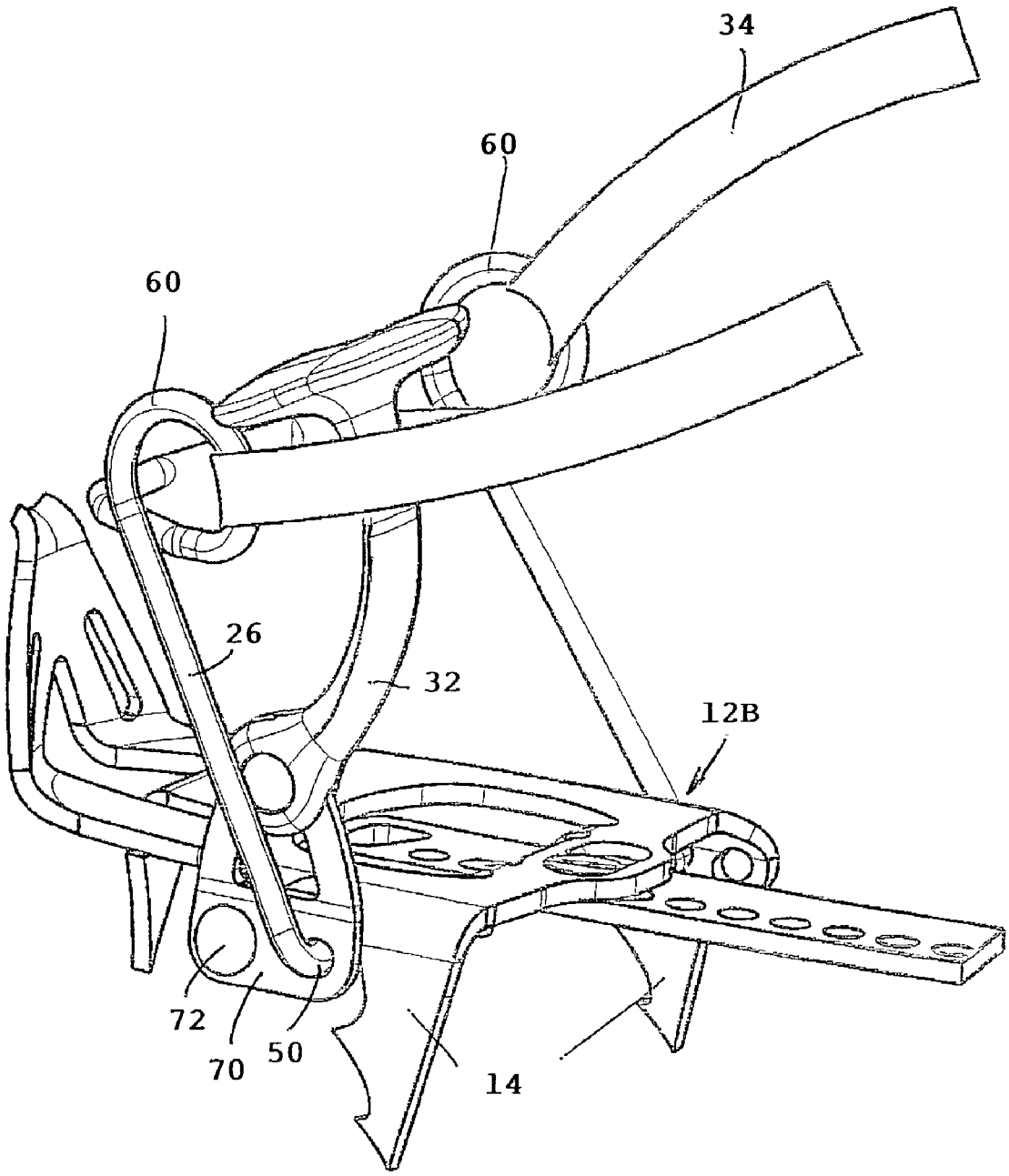

On the variation of FIGS. 8 and 9, the toggle joint fastening mechanism 30 is composed of an intermediate rod 70 whereon are hinged the fastening stirrup 26 and the operating lever 32. The rod 70 is mounted to pivot on the axle 72 of a tab integral with the frame 12B.

Instead of assembling the toggle joint fastening device 30 on the rear frame 12B, it is also possible to reverse it while adapting said device on the front frame 12A.

According to another variation, a second operating lever (not represented) can be mounted symmetrically on the reinforcement in order to form a mechanism with double lateral levers.

What is claimed is:

1. An ice crampon for mountain climbing comprising:

a metal reinforcement (12) comprised of a front frame (12A) linked to a rear frame (12B) by a linking bar (18) adjustable in length, each front frame and rear frame having anchoring teeth (14);

a fastening device (30) for fastening said metal reinforcement (12) to a sole (16) of a shoe via a first fastening element (20) and a second fastening element (26) arranged respectively at the front frame and at the rear frame;

a lateral operating lever (32) extending on a side of the metal reinforcement for actuating said fastening device; and an articulation means for receiving a first end (50) of the second fastening element (26), and cooperating with said operating lever in order to build a toggle joint for locking or unlocking the ice crampon on the sole (16) upon pivoting of said operating lever, said articulation means being formed by an intermediate rod (70), wherein the second fastening element (26) and the operating lever (32) are hinged on the intermediate rod, and wherein the intermediate rod is connected to the rear frame so as to pivot around an axle (72), integral with the rear frame (12B), wherein the connection between the intermediate rod and the rear frame is spaced from the hinge between the intermediate rod and the fastening element and the hinge between the intermediate rod and the operating lever.

2. An ice crampon for mountain climbing according to claim 1, wherein said articulation means is formed by a rotary socket (52) carried by an extension (54) of the elbow-shaped operating lever (32), whereas the toggle joint crossing over a neutral position in a locking direction ensures a stable position of the operating lever (32).

3. An ice crampon for mountain climbing according to claim 1, wherein the operating lever (32) is provided with an axis of articulation (56) which is housed in a first rack (46) to allow longitudinal adjustment of the second fastening element (26).

4. An ice crampon for mountain climbing according to claim 3, wherein the second fastening element (26) has a second end (48) which is mounted directly in a second rack (46) situated on a side opposite to the operating lever (32).

5. An ice crampon for mountain climbing according to claim 4, wherein said first and second racks (46) are arranged symmetrically with respect to a median longitudinal plane of the metal reinforcement (12).

6. An ice crampon for mountain climbing according to claim 1, wherein the operating lever (32) is housed on the rear frame (12B).

7. An ice crampon for mountain climbing according to claim 6, wherein the second fastening element (20) is composed of a metal stirrup comprising two buckles (60) for hooking a safety belt (34).

8. An ice crampon for mountain climbing according to claim 7, wherein the operating lever (32) is provided with a gripping end inserted into one of the buckles (60) in a locking position.

9. An ice crampon for mountain climbing according to claim 8, wherein the operating lever (32) comprises an unlocking ring (62) made active to cross over a neutral point of the toggle joint in order to unlock the toggle joint.

* * * * *